US008324809B2

(12) United States Patent
Gardelle

(10) Patent No.: US 8,324,809 B2
(45) Date of Patent: Dec. 4, 2012

(54) STRONG POWER COMPACT MICROWAVE TUBE

(75) Inventor: Jacques Gardelle, Pessac (FR)

(73) Assignee: Commissariat a l'Energie Atomique, Paris (FR)

( * ) Notice: Subject to any disclaimer, the term of this patent is extended or adjusted under 35 U.S.C. 154(b) by 349 days.

(21) Appl. No.: 12/564,874

(22) Filed: Sep. 22, 2009

(65) Prior Publication Data

US 2010/0090602 A1 Apr. 15, 2010

(30) Foreign Application Priority Data

Sep. 29, 2008 (FR) ..... 08 56522

(51) Int. Cl.
*H01J 25/50* (2006.01)

(52) U.S. Cl. ..... 315/39.51; 315/39.53; 315/39.71

(58) Field of Classification Search ..... 315/5.31, 315/4, 5, 5.13, 5.21, 5.35, 5.38, 5.41, 501, 315/39.51, 39.53, 39.57, 39.75, 39.71, 39.77, 315/84.61, 85

See application file for complete search history.

(56) References Cited

U.S. PATENT DOCUMENTS 4,800,322 A 1/1989 Symons
5,101,168 A 3/1992 Miller
5,818,170 A * 10/1998 Kikunaga et al. ..... 315/5

FOREIGN PATENT DOCUMENTS

EP 0490741 6/1992
WO 9323867 11/1993

OTHER PUBLICATIONS

French Preliminary Search Report for French Patent Application No. FR 0856522, dated Jun. 15, 2009.

* cited by examiner

*Primary Examiner* — Douglas W Owens
*Assistant Examiner* — Jianzi Chen
(74) *Attorney, Agent, or Firm* — Nixon Peabody LLP

(57) ABSTRACT

A microwave tube including: a) an electron gun capable of producing a beam of electrons in the form of a hollow axi-symmetrical cylinder in repetitive operation; and b) a body in which the beam is intended to propagate, the body ending with a collector and being provided with means for applying an axial magnetic field for guiding the beam and, upstream from the collector, with a resonant structure crossed by the beam, intended to group the electrons into a succession of packets (P). The resonant structure is formed with two coupled cavities which follow along the axis (Z) of the beam, the coupling being achieved via an inter-cavity region crossed by the beam, this structure having axial symmetry the axis of which is that of the beam and being dimensioned so that the transformation of the electrons in packets is accomplished at a frequency which is that of the π resonant mode of the resonant structure.

11 Claims, 4 Drawing Sheets

STRONG POWER COMPACT MICROWAVE TUBE

CROSS REFERENCE TO RELATED APPLICATIONS OR PRIORITY CLAIM

Figure 1:
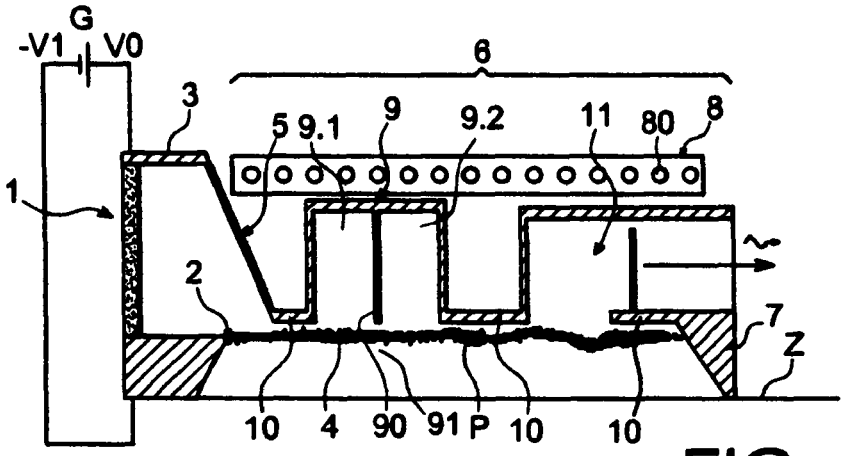

This application claims priority of French Patent Application No. 08 56522, filed Sep. 29, 2008.

TECHNICAL FIELD

The present invention relates to compact strong power microwave tubes capable of operating repetitively. By strong power is meant a power larger than or equal to about 100 MW.

STATE OF THE PRIOR ART

Existing strong power performing microwave tubes capable of operating repetitively are notably relativistic klystrons and tubes known under the trade name of Reltron.

These vacuum tubes produce microwaves from intense relativistic electron beams. The acceleration of the electrons in the body of the tube is such that they attain velocities close to that of light. These electron beams are produced by the cathode of an electron gun also comprising an anode and propagate in the body of the tube which follows the gun, the body of the tube including suitable electromagnetic structures and a collector for recovering the electrons at the end of the travel once they have yielded a large portion of their energy. The main parameters of electron beams, i.e. their energy, their current and the repetition rate of produced electron bursts strongly depend on the power source which powers the electron gun also called electrotechnical generator. The orders of magnitude of these parameters are the following: 200 keV to 1 MeV for energy, 500 A to 20 kA for the current and a few tens of Hertz for the repetition rate.

In every case, in order to obtain these performances, the electrons of the beam have to be transformed into packets with the desired frequency. This frequency may be comprised in the range from 2 to 5 GHz. This transformation into packets is accomplished in electromagnetic structures located in the body of the tube.

Presently, relativistic klystrons use means for focusing the electron beams which are formed with solenoids in order to produce a pulsed magnetic field required for propagating the electron beam in the body of the tube. The magnetic field for example varies between 0.5 and 1 Tesla according to the value of the electric current to be propagated. But, with this type of focusing means, it is only possible to produce the magnetic field in pulsed operation for only very short times, of the order of one millisecond, if the intention is not to be forced to provide cooling means and a very cumbersome power supply. These times are incompatible with the sought recurrent operation over several seconds.

Focusing means of the superconducting solenoid type may be used but in this case, the cost and bulkiness would be redhibitory.

As regards Reltron, reference may be made to U.S. Pat. No. 5,101,168 which describes such a tube operating in an amplifying mode. The electron beam is solid and not hollow and it passes through a resonant structure which allows it to be transformed into packets. The electron beam from its formation by the gun and its propagation in the body passes through a certain number of grids to which it yields energy. This leads to the destruction of these grids by heating, to contamination of the tube and to interruption of its operation. It is realized that such as tube cannot operate at repetition frequencies higher than about a few Hertz.

DISCLOSURE OF THE INVENTION

The object of the present invention is precisely to propose a compact strong power microwave tube capable of operating recurrently and which does not have the drawbacks mentioned above.

An object of the invention is therefore to provide a power microwave tube capable of operating at repetition frequencies above about hundred Hertz and this for several seconds or even several tens of seconds.

Another object of the invention is to provide a power microwave tube which is relatively lightweight, compact and inexpensive.

In order to achieve this, the microwave tube includes an electron gun producing a hollow beam of electrons and a resonant structure with two coupled cavities which transforms the electron beam into packets at the frequency of the resonant mode $\pi$ of the resonant structure.

More specifically, the invention more particularly relates to a microwave tube including:

an electron gun capable of producing an electron beam in the form of a hollow axisymmetrical cylinder in repetitive operation, a body in which the beam is intended to propagate, the body ending with a collector and being provided with means for applying an axial magnetic field for guiding the beam, and upstream from the collector with a resonant structure crossed by the beam. The resonant structure is intended to group the electrons into a succession of packets. It is unique and formed with two coupled cavities which follow each other along the axis of the beam, the coupling being accomplished via an intercavity region crossed by the electron beam, this resonant structure has axial symmetry, the axis of which is that of the beam, and being dimensioned so that the transformation of the electrons into packets is accomplished at a frequency which is that of the resonant mode $\pi$ of the resonant structure.

The two cavities advantageously are of the pill box type.

Both cavities may be placed side by side and have a common wall equipped with an iris substantially centered on the axis of the electron beam in order to let through the electron beam, the coupling between both cavities being accomplished by the iris.

It is advantageous if the electron gun is of the diode type with an annular cathode and an anode substantially mounted coaxially around the cathode. Thus, the beam does not have to cross an anode of the grid type.

The anode may be a portion of a vacuum chamber of the tube encompassing the body.

The electron beam may thus propagate from the electron gun and in the tube body without encountering any obstacle of the grid or sheet type.

The body includes an output circuit from which the microwave energy of the electron beam may be extracted, placed between the collector and the resonant structure.

In order to increase the energy of the electron beam at the output circuit, it is preferable that the body should have a section for post-acceleration of the electrons of the electron beam placed between the resonant structure and the output circuit.

The means for applying the axial magnetic guiding field may include one or more solenoids or one or more tubular permanent magnets.

The resonant structure may be equipped with means for varying its resonance frequency, aiming at adjusting at least locally the space between the electron beam and a sidewall of at least one cavity of the resonant structure.

SHORT DESCRIPTION OF THE DRAWINGS

Figure 2A:
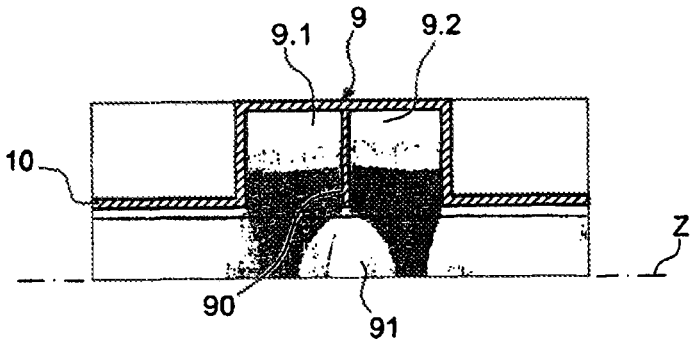
Figure 2B:
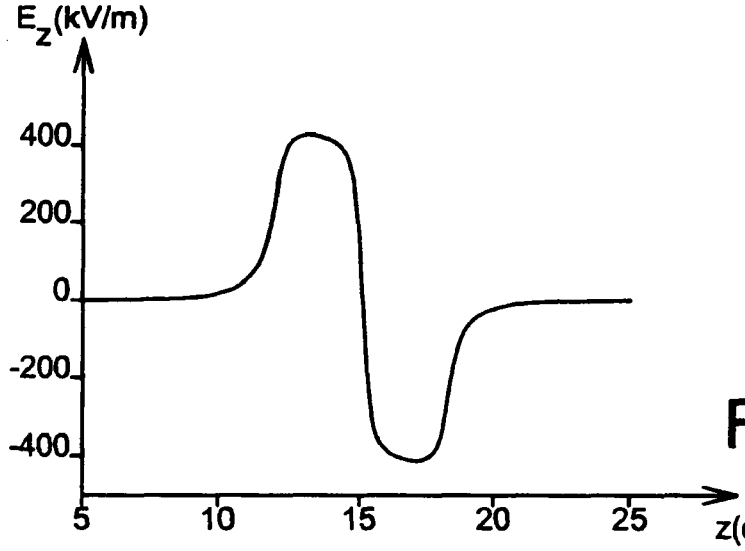
Figure 3A:
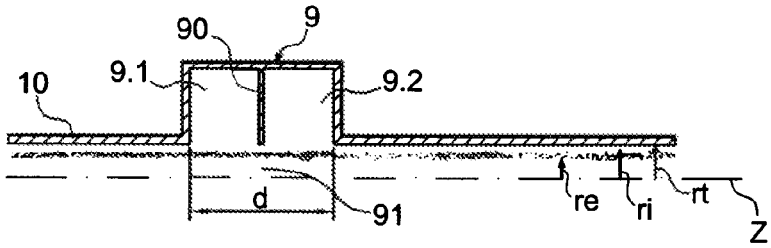
Figure 3B:
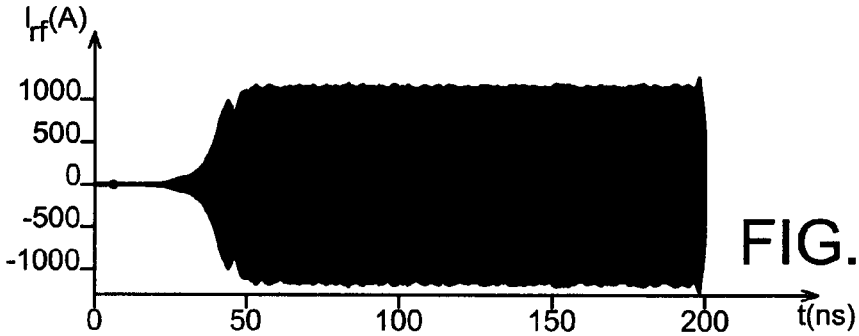

The present invention will better understood upon reading the description of exemplary embodiments given purely as an indication and by no means as a limitation, with reference to the appended drawings wherein:

FIG. 1 schematically shows a longitudinal sectional view of a first example of a microwave tube according to the invention;

FIGS. 2A, 2B schematically show the resonant structure and the instantaneous electric field which is established therein;

FIG. 3A schematically shows the resonant structure and FIG. 3B shows in position A, the electron current versus time, after filtering.

Figure 4A:
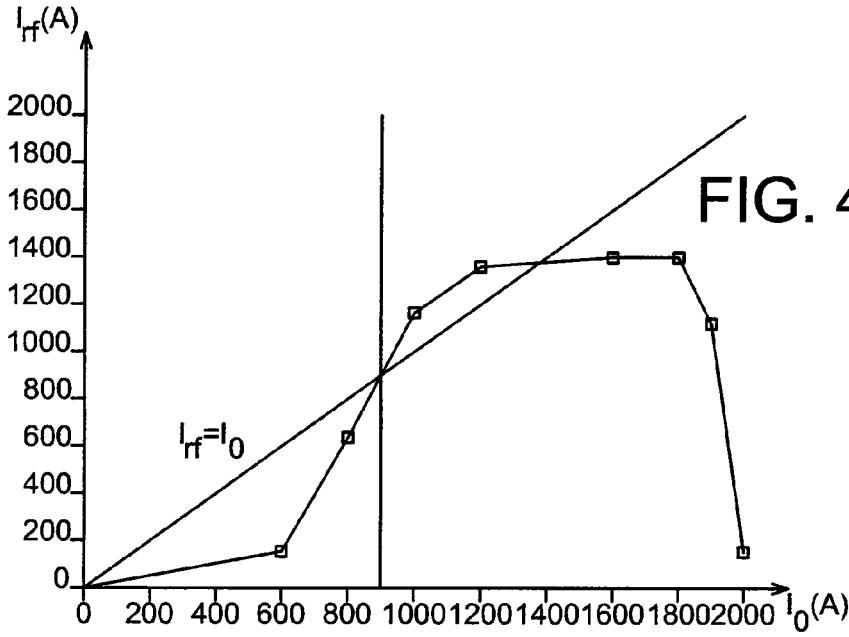
Figure 4B:
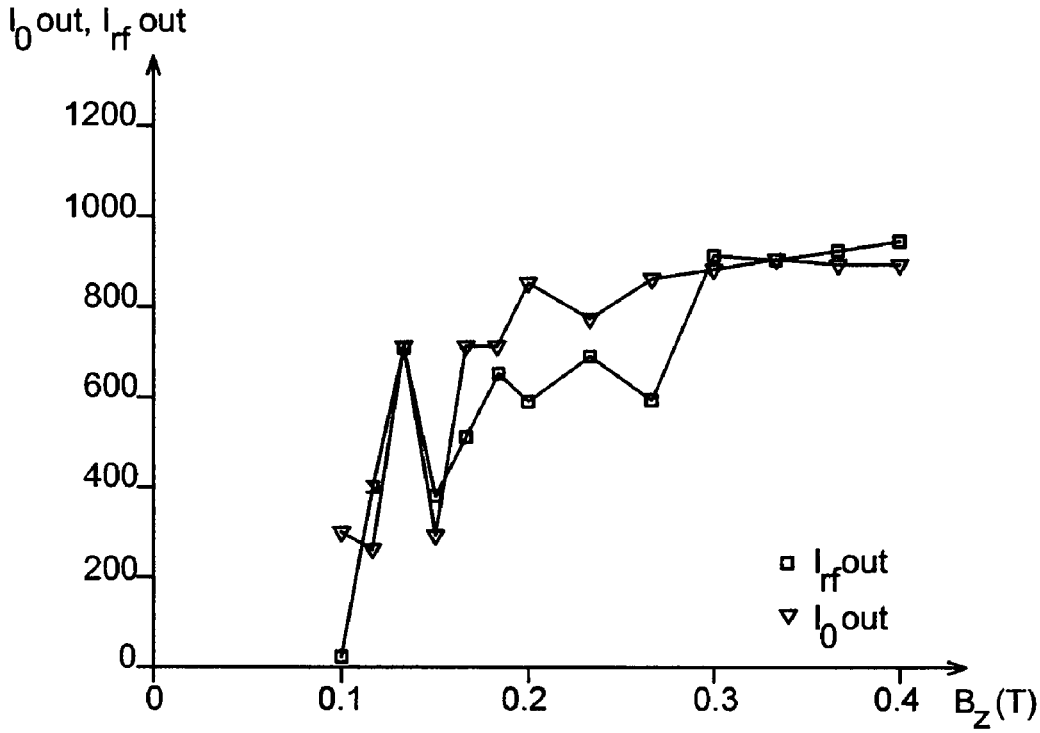
Figure 5:
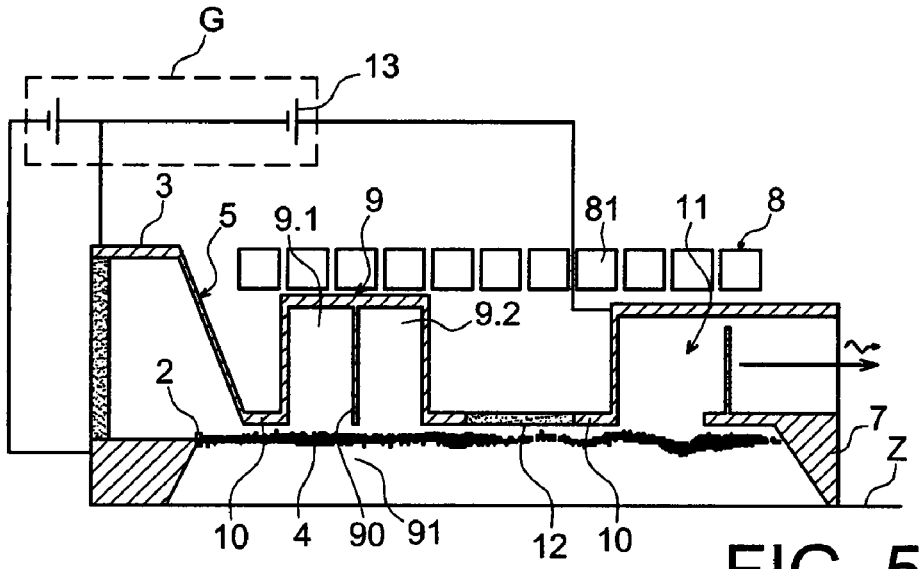
Figure 6A:
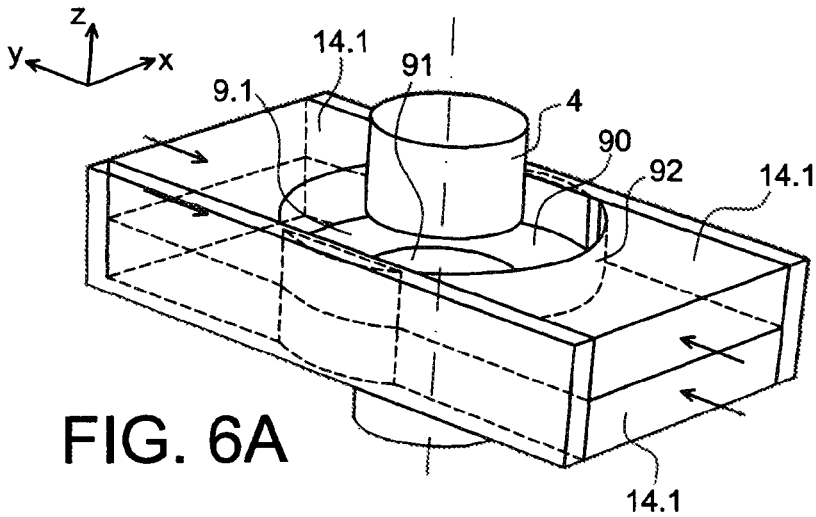
Figure 6B:
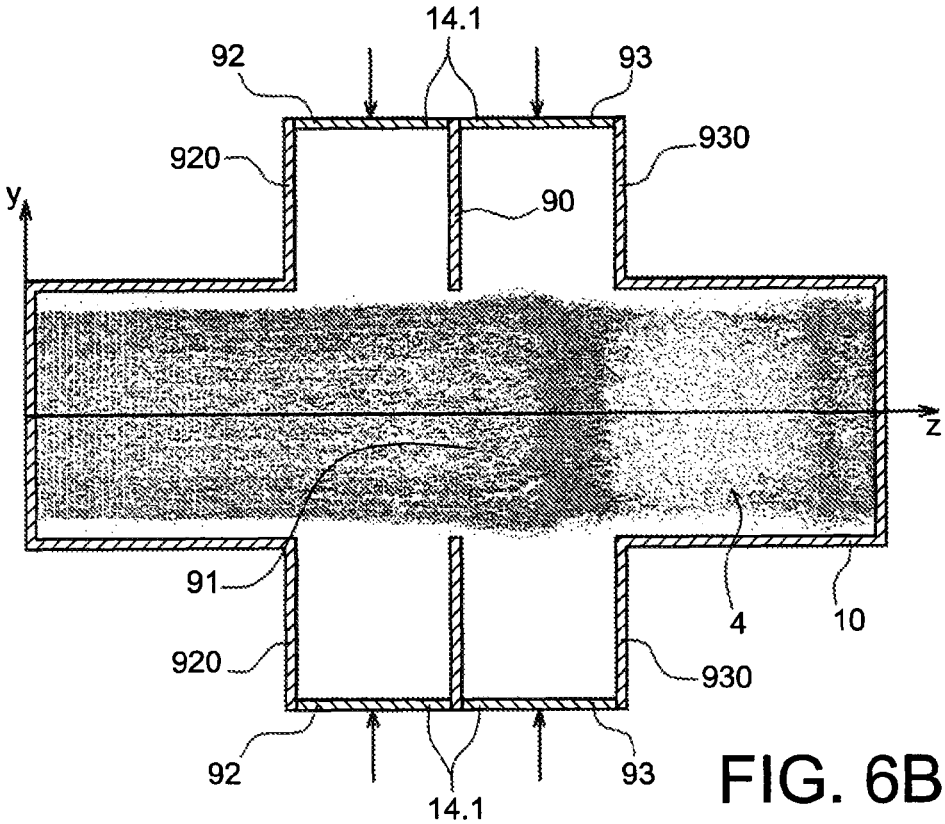

FIG. 4A shows the variation of the current of the beam of electrons transformed into packets versus the current of the electron beam injected into the body of the tube and FIG. 4B the variation of the average current $I_0$out and of the modulated current $I_{rf}$out at the output circuit versus the axial magnetic induction;

FIG. 5 schematically illustrates a longitudinal sectional view of another example of the microwave tube according to the invention equipped with a post-acceleration section;

FIGS. 6A and 6B show in three dimensions and in a sectional view the resonant structure equipped with means for varying its resonance frequency.

Identical, similar or equivalent portions of the different figures described hereafter bear the same numerical references so as to facilitate passing from one figure to the other.

The different portions illustrated in the figures are not necessarily illustrated according to a uniform scale, in order to make the figures more legible.

DETAILED DISCLOSURE OF PARTICULAR EMBODIMENTS

Reference will now be made to FIG. 1 which very schematically shows a first example of a power microwave tube, object of the invention. Only half of the tube is illustrated.

The microwave tube object of the invention is built around an axis Z. It includes in a vacuum chamber 5 encompassing an electron gun 1 of the diode type with an annular cathode 2 centered on the axis Z and an anode 3 consisting of a tubular frame substantially mounted coaxially around the cathode 2. The anode 3 may be formed with a portion of the vacuum chamber 5 of the tube as this will be seen subsequently.

The electron gun 1 is capable of producing an electron beam 4 with the shape of a hollow axisymmetrical cylinder when a suitable potential difference is applied between its cathode 2 and its anode 3. The cylinder has the Z axis as its axis. The cathode 2 is set to a more negative potential −V1 than the potential V0 to which is set the anode 3. The potential V0 of the anode 3 is the ground insofar that the anode consists of a portion of the vacuum chamber 5 of the tube. The electron gun 1 is intended to be controlled by pulses and for this it is intended to be electrically connected to a repetitive electrotechnical generator G which delivers the preceding potentials.

The microwave tube further includes a body 6 which follows the electron gun 1.

Application to the cathode 2 of the negative potential −V1 relatively to that of the anode 3 causes emission of the hollow electron beam 4 which propagates in the body 6 and more particularly in a tunnel 10 for the electron beam, the body 6 ending with a collector 7 which recovers the electrons at the end of travel. Thus the tunnel 10 extends into the body 6 between the electron gun 1 and the collector 7.

The body 6 further includes upstream from the collector 7 a unique resonant structure 9 with axial symmetry (Z axis) with two coupled cavities 9.1, 9.2, open on the electron beam tunnel 10, which allows interaction between the electron beam 4 and the resonant structure 9. Coupling between both cavities 9.1, 9.2 is accomplished via an intercavity region crossed by the electron beam 4. This resonant structure 9 is intended to transform the electrons of the beam 4 into packets P at the frequency of the resonance mode π of the resonant structure 9 with two coupled cavities. This means that the instantaneous electric field which is established in one of the cavities 9.1 is in an opposition phase with the one which is established in the other cavity 9.2. Reference may be made to FIGS. 2A and 2B which illustrate the resonant structure 9 on the one hand and the change in the instantaneous electric field which is established in the tunnel at the resonant structure 9.

In the illustrated example, the resonant structure 9 is formed with two cavities 9.1, 9.2 placed side by side by a middle wall 90 provided with an iris 91 centered on the Z axis. The electron beam 4 crosses the iris 91. The cavities are of the pill box type. The coupling between both cavities 9.1, 9.2 is accomplished by the iris 91, which corresponds to the intercavity region. In order to obtain the best possible coupling, it is attempted to have the cavities as close to each other as possible. Both cavities 9.1, 9.2 are substantially identical. The middle wall 90 is substantially normal to the Z axis. It is assumed that the iris 91 has substantially the dimensions of a cross-section of the tunnel 10.

The body of the tube 6 is further provided with means for applying a longitudinal magnetic field 8 along the axis Z for guiding the electron beam 4 in order to focus the thereby produced electron beam 4 and prevent it from diverging in the body 6 upstream from the collector. These magnetic field application means 8 surround the covering 5.

Finally, the microwave tube includes an output circuit 11 located upstream from the collector 7, it is intended for extracting microwave energy yielded by the electrons before their capture by the collector 7. The output circuit 11 includes at least one cavity. This output cavity type is well-known to the person skilled in the art of microwave tubes. The electrons have their kinetic energy converted into electromagnetic energy at the output circuit 11 before reaching the collector 7 and it is this electromagnetic energy which is extracted from the output circuit in order to be exploited.

It is sought to have all the electrons of the electron beam 4 transformed into packets as rapidly as possible, for this, the total transformation into packets should take place in the tunnel, as close as possible to the output of the resonant structure 9. The time for transforming all the electrons into packets from the starting of the gun 1 of course depends on the dimensions of the resonant structure 9 but also on the intensity of the injected current $I_0$ generated by the electron gun 1. The injection current $I_0$ corresponds to the average current emitted during a pulse.

FIG. 3A illustrates the aspect of the electron beam in the tunnel 10 at the resonant structure 9 and in its upstream and downstream vicinity. Transformation of the electrons into packets at the output of the resonant structure 9 is well visible and is complete from the position A at a few centimeters from the output of the resonant structure 9. FIG. 3B moreover illustrates the aspect of the current of the electron beam transformed into packets $I_{rf}$ (further called modulated current) versus time, at position A in the tunnel 10. This current $I_{rf}$ is superposed to the injected current $I_0$. It is necessary to wait for about 40 ns from the beginning of the injection of the electrons in the tunnel 10 in order to transform all the electrons into packets.

These results are obtained by simulating the behavior of electrons, electric and magnetic fields by means of a PIC (Particle In Cell) type algorithm marketed under the name of MAGIC. The electron beam, the gun and the tunnel have the following characteristics:

Injected beam voltage: Vinj=200 kV, it corresponds to the anode-cathode voltage difference Injected beam current: $I_0$=1000 A External radius of the beam: re=20 nm Internal radius of the beam: ri=18 nm Internal radius of the tunnel: rt=24 nm Distance covered by the electrons for passing through the resonant structure: d=6.2 cm length of each of the cavities: 3 cm It is noticed that for an injected current $I_0$ of 1 kA, the time required for speed-modulating all the electrons is of the order of 40 ns.

In the investigated example, the spacing between both cavities is 0.2 cm which corresponds to the thickness of the middle wall. Simulations were carried out with spaces ranging up to about 3 centimeters but with less satisfactory results.

FIG. 4A illustrates the aspect of the modulated current $I_{rf}$ of the electron beam transformed into packets versus in the injected current $I_0$, it is noticed that a current of at least 900 A has to be injected in order to obtain transformation of all the electrons of the beam into packets.

With this type of microwave tube type, it is realized that the magnetic field produced by the magnetic field application means 8 does not have to be as large as in relativistic klystrons for a same electron beam output energy. It is adjusted so that the electron beam transformed into packets propagates without dispersion as far as the output circuit 11. FIG. 4B illustrates the variation of the average current $I_0$out and of the modulated current $I_{rf}$out on the one hand at the output circuit 11 versus the induction Bz along the axis Z. It is noticed that the required magnetic field threshold for propagating the electron beam in packets without its dispersion has a magnetic induction value larger than 0.2 Tesla. In relativistic klystrons, larger magnetic inductions of the order of 0.5 to 1 Tesla or even more have to be produced.

The means for applying the magnetic field 8 may be produced by at least one solenoid 80 surrounding the body 6. This solenoid 80 may only be powered with energy during the time when the electron gun produces electrons. Reference may be made to FIG. 1.

Alternatively, a succession of annular magnets 81 may be used, as schematized in FIG. 5. These magnets 81 may be available commercially, if the resonance frequency of the resonant structure is not too low. The annular magnets are for example suitable if the frequency is above 2 GHz. The annular magnets are illustrated in FIG. 5 described below.

Simulations show that in the S band (2 to 4 GHz) the tube operates with an electron beam having an energy of the order of 200 keV and an injected current $I_0$ of the order or larger than 1 kA. The tube may also operate in a wider band from 1.5 to 5 GHz.

In order to increase the energy provided by the microwave tube, object of the invention, it is possible to include in the body 6 a post-acceleration section 12. This post-acceleration section 12 is positioned between the resonant structure 9 and the output circuit 11 as illustrated in FIG. 5. The presence of this post-acceleration section 12 causes the output circuit 11 to be without any electric contact with the anode 3. Means 13 are then provided for applying to the output circuit 11 a more positive potential than that of the anode 3. A potential difference of about 800 kV may be applied between the anode 3 and the output circuit 11. This post-acceleration section 12 may be formed in the same way as in the Reltron tube. It is connected on one side to the resonant structure 9 and on the other side to the output circuit 11.

It is possible that the resonant structure 9 be equipped with a device 14 for tuning the resonance frequency of the resonant structure 9. Reference is made to FIGS. 6A and 6B. This tuning device 14 may be formed by at least one component of the actionable plunger type 14.1 from the outside of the tube by a suitable control device so as to modify the volume of the resonant structure 9. The control device may be a rod. The change in the volume of the resonant structure 9 may consist of displacing at least one portion of a sidewall 92, 93 of at least one of the cavities 9.1, 9.2 so as to bring it closer or move it away from the electron beam 4. In the example described in FIGS. 6A and 6B, each component of the plunger type 14.1 displaces a sidewall portion, which corresponds to a portion of the circumference of a cavity 9.1 or 9.2. The displacement is performed substantially normally to the Z axis, so that the inner radius of the cavity 9.1 or 9.2 varies locally.

In FIG. 6A, the resonant structure 9 is illustrated in three dimensions. It has an external shape substantially as a right angle parallelepiped and interiorly substantially as an axisymmetrical cylinder of axis Z. It has a middle wall 90 provided with an iris 91 centered on the Z axis for letting through the electron beam 4. This middle wall separates both of the cavities 9.1, 9.2 placed side by side as an axisymmetrical cylinder. In fact, in FIG. 6A only the cavity 9.1 is visible as well as the sidewall 92. The middle wall 90 is substantially normal to the Z axis. Each cavity 9.1, 9.2 includes an extreme wall 920, 930 visible in FIG. 6B, this extreme wall 920, 930 being also substantially transverse to the Z axis. Both of these extreme walls 920, 930 form the input wall and the output wall of the resonant structure 9, respectively. The electron beam 4 enters and exits the resonant structure 9 by crossing these extreme walls 920, 930.

In the described example, two components of the plunger type 14.1 per cavity 9.1, 9.2 are placed, they are diametrically opposite. The plunger type components 14.1 are mobile in the fashion of a drawer relatively to the middle wall 90 and to the extreme walls 920, 930.

Such a frequency-tuning device 14 is easy to make, it is mechanically simpler than that of Reltron. Indeed, in the Reltron tube, the tuning device is more difficult to apply because in the resonant structure, coupling is achieved by a remote cavity away from the electron beam axis and only a reduced frequency change may be obtained.

It should be noted that the electron gun and the tunnel which follows it are free of any obstacles of the metal thin sheet or grid type which the electron beam has to cross. With this, it is also possible to avoid contamination problems which are encountered in Reltrons.

With this type of tube, the limitation of the repetition rate no longer depends on the different components of the tube but depends on the electrotechnical generator which is used for powering its electron gun. This repetition rate may be of the order of several hundred Hertz or even more.

The fact of using a hollow electron beam allows propagation of a more intense current than if it was solid, with constant guiding magnetic field.

The electronic tube according to the invention having the characteristics given above is particularly compact, its length is of the order of about forty centimeters for a diameter less than about twenty centimeters, this diameter being conditioned by the useful central frequency of the resonant structure.

Although several embodiments of the present invention have been illustrated and described in a detailed way, it will be understood that various changes and modifications may be made without departing from the scope of the invention.

The invention claimed is:

1. A microwave tube including:

an electronic gun capable of producing an electronic beam in the form of a hollow axisymmetrical cylinder in repetitive operation, a body, in which the beam is intended to propagate, the body ending with a collector and being provided with means for applying an axial magnetic field for guiding the beam and downstream from the collector, with a resonant structure crossed by the beam, intended to group the electrons into a succession of packets (p), characterized in that the resonant structure intended for grouping the electrons into the succession of packets (P) is unique and is formed with two coupled cavities which follow along the axis (Z) of the beam, the coupling being achieved via an interactivity region crossed by the beam, this structure having axial symmetry, the axis of which is that of the beam and being dimensioned so that the transformation of the electrons into packets is accomplished at a frequency which is that of the $\pi$ resonant mode of the resonant structure.

2. The microwave tube according to claim 1, wherein both cavities are of the pill box type.

3. The microwave tube according to claim 1, wherein both cavities are placed side by side and have a common wall equipped with an iris substantially centered on the axis (Z) of the beam in order to let through the beam, the coupling between both cavities being accomplished by means of the iris.

4. The microwave tube according to claim 1, wherein the electron gun is of the diode type with an annular cathode, and an anode substantially mounted coaxially around the cathode.

5. The microwave tube according to claim 4, wherein the anode is a portion of a vacuum chamber of the tube encompassing the body.

6. The microwave tube according to claim 1, wherein the electron gun and the body of the tube upstream from the collector are free of any obstacles of the grid or sheet type for the electron beam.

7. The microwave tube according to claim 1, wherein the body includes an output circuit from which the microwave energy of the electron beam may be extracted, placed between the collector and the resonant structure.

8. The microwave tube according to claim 7, wherein the body of the tube includes a post-acceleration section for the electrons of the electron beam, placed between the resonant structure and the output circuit.

9. The microwave tube according to claim 1, wherein the means for applying the guiding axial magnetic field include one or more solenoids or one or more permanent magnets.

10. The microwave tube according to claim 1, wherein the resonant structure is equipped with means in order to vary its resonance frequency, aiming at adjusting at least locally the space between the electron beam and a sidewall of at least one cavity of the resonant structure.

11. A microwave tube including:

an electronic gun capable of producing an electronic beam in the form of a hollow axisymmetrical cylinder in repetitive operation, a body, in which the beam is intended to propagate, the body ending with a collector and being provided with means for applying an axial magnetic field for guiding the beam and downstream from the collector, with a resonant structure crossed by the beam, intended to group the electrons into a succession of packets (p), characterized in that the resonant structure intended for grouping the electrons into the succession of packets (P) is unique and is formed with two coupled cavities which follow along the axis (Z) of the beam, the coupling being achieved via an interactivity region crossed by the beam, this structure having axial symmetry, the axis of which is that of the beam and being dimensioned so that the transformation of the electrons into packets is accomplished at a frequency which is that of the $\pi$ resonant mode of the resonant structure, wherein the resonant structure is equipped with means in order to vary its resonance frequency, aiming at adjusting at least locally the space between the electron beam and a sidewall of at least one cavity of the resonant structure.

* * * * *